US005931569A

United States Patent [19]

Anderson

[11] Patent Number: 5,931,569

[45] Date of Patent: Aug. 3, 1999

[54] REFLECTOR WITH STROBE LIGHT EXTENDING THEREFROM

[75] Inventor: Douglas J. Anderson, South Elgin, Ill.

[73] Assignee: Pittway Corporation, Chicago, Ill.

[21] Appl. No.: 08/811,542

[22] Filed: Mar. 4, 1997

[51] Int. Cl.[6] ..... F21V 7/06

[52] U.S. Cl. ..... 362/346; 362/297; 362/347

[58] Field of Search ..... 362/217, 294, 362/297, 301, 305, 346, 349, 347

[56] References Cited

U.S. PATENT DOCUMENTS

| | | | |
|---|---|---|---|
| 330,742 | 11/1885 | Scovil . | |
| 678,942 | 7/1901 | Cox . | |
| 823,392 | 6/1906 | Burnfield . | |
| 1,224,189 | 5/1917 | Maltby . | |
| 1,235,274 | 7/1917 | Wood . | |
| 1,292,637 | 1/1919 | Patch . | |
| 1,365,319 | 1/1921 | Hazard . | |
| 1,478,564 | 12/1923 | Hallett . | |
| 1,639,363 | 8/1927 | Balsillie . | |
| 1,658,265 | 2/1928 | Thompson . | |
| 1,732,884 | 10/1929 | Foster . | |
| 1,814,326 | 7/1931 | Melton . | |
| 1,903,330 | 4/1933 | Young et al. . | |
| 1,913,518 | 6/1933 | Smith et al. . | |
| 1,950,380 | 3/1934 | Arras | 240/104 |
| 2,274,405 | 2/1942 | Flaherty | 240/25 |
| 3,176,124 | 3/1965 | Cibie | 362/217 |
| 3,638,010 | 1/1972 | Moore | 240/3 |
| 3,758,770 | 9/1973 | Morasz | 240/41.36 |
| 4,028,542 | 6/1977 | McReynolds, Jr. | 240/41.36 |
| 4,112,483 | 9/1978 | Small, Jr. et al. | 362/298 |
| 4,293,900 | 10/1981 | Dziubaty | 362/342 |
| 4,308,573 | 12/1981 | McNamara, Jr. | 362/297 |
| 4,310,876 | 1/1982 | Small, Jr. et al. | 362/298 |
| 4,409,646 | 10/1983 | Baliozian | 362/319 |
| 4,447,865 | 5/1984 | VanHorn et al. | 362/305 |
| 4,481,563 | 11/1984 | Snyder et al. | 362/296 |
| 4,494,176 | 1/1985 | Sands et al. | 362/297 |
| 4,544,999 | 10/1985 | Kawanami et al. | 362/298 |
| 4,575,788 | 3/1986 | Lewin | 362/346 |
| 4,633,377 | 12/1986 | Mackiewicz | 362/309 |
| 4,704,661 | 11/1987 | Kosmatka | 362/61 |
| 4,754,375 | 6/1988 | Ferenc | 362/217 |
| 4,905,133 | 2/1990 | Mayer et al. | 362/346 |
| 4,928,214 | 5/1990 | Oyama | 362/61 |
| 5,034,867 | 7/1991 | Mayer | 362/297 |
| 5,249,110 | 9/1993 | Russello et al. | 362/294 |
| 5,251,116 | 10/1993 | Wijbenga et al. | 362/308 |
| 5,303,126 | 4/1994 | Taniuchi | 362/61 |
| 5,305,189 | 4/1994 | Sekiguchi | 362/61 |
| 5,390,095 | 2/1995 | Lemons et al. | 362/301 |
| 5,416,683 | 5/1995 | McCarthy | 362/328 |
| 5,418,420 | 5/1995 | Roberts | 313/114 |
| 5,426,575 | 6/1995 | Richards | 362/283 |
| 5,448,462 | 9/1995 | Moran, III . | |
| 5,475,361 | 12/1995 | Curran et al. | 362/217 |

*Primary Examiner*—Laura K. Tso
*Attorney, Agent, or Firm*—Rockey, Milnamow & Katz, Ltd.

[57] ABSTRACT

A wall-mountable strobe unit emits radiant energy over a one hundred eighty degree arc in a horizontal plane and over a ninety degree arc in a vertical plane when so mounted. The unit includes a reflector and an elongated light source. The elongated light source is symmetrically positioned on the reflector with one end thereof carried on the reflector with the light source extending in the horizontal plane when so mounted. The reflector includes first and second planar elements symmetrically located with respect to the light source. The planar elements are joined by symmetrically located curved elements formed of partial parabolic surfaces. The partial parabolic surfaces extend from the planar elements first rising a predetermined amount from the planar elements and then falling back toward the planar elements. Two additional partial parabolic surfaces are positioned adjacent to the planar surfaces, symmetrically located with respect to the light source and displaced from the parabolic surfaces with the planar surfaces therebetween.

33 Claims, 10 Drawing Sheets

FIG. 12
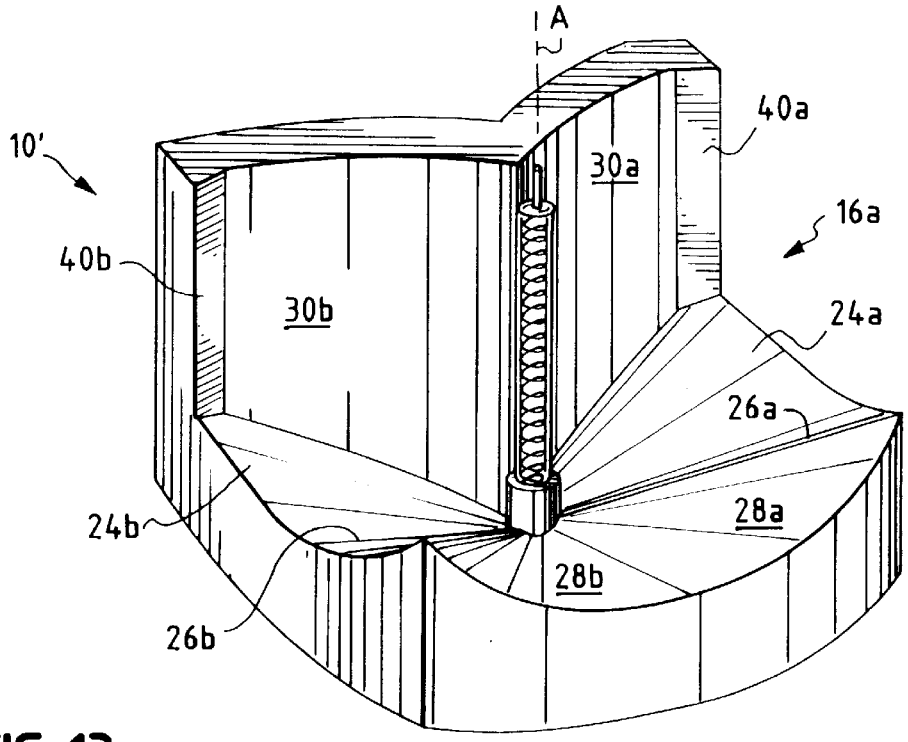
FIG. 13
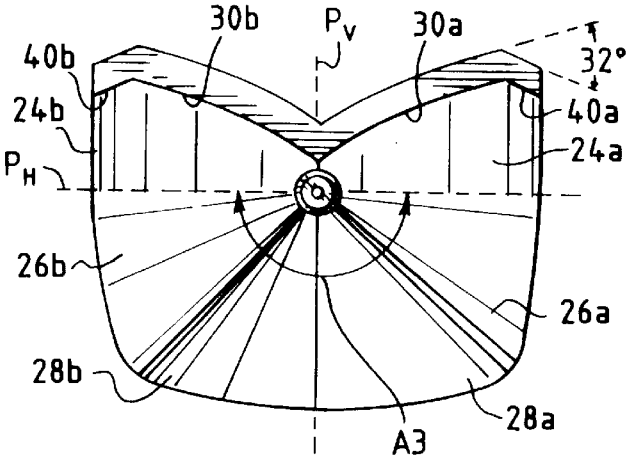
FIG. 14
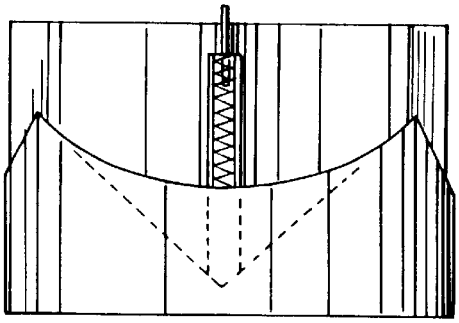
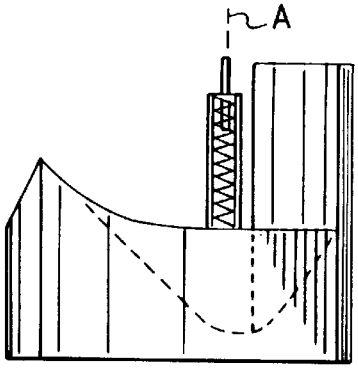
FIG. 15

REFLECTOR WITH STROBE LIGHT EXTENDING THEREFROM

FIELD OF THE INVENTION

The invention pertains to strobe units which emit high intensity pulses of radiant energy over wide viewing fields. More particularly, the invention pertains to such strobe units wherein an elongated cylindrical light source extends from a reflector in a plane of symmetry so as to emit light at least over a one hundred eighty degree arc in a horizontal plane and at least over a ninety degree arc in a vertical plane.

BACKGROUND

High intensity strobe units for emitting pulses of radiant energy over large viewing angles are known. One such structure is disclosed and claimed in Moran U.S. Pat. No. 5,448,462 assigned to the Assignee of the present invention.

While known units provide appropriate levels of visible radiant energy over wide angles, such as would be used to visually indicate a fire alarm, it would be desirable to be able to improve the efficiency of such units and reduce the electrical power required to drive such units. Reduction of electrical power, if achievable, is particularly important in that more strobe units can be driven from the same size power supply, using the same size distribution cables, then would heretofore be feasible.

In addition to reducing the amount of energy needed to energize a given unit, it would be desirable to provide as much light as possible to coordinates off of the horizontal and vertical planes. Preferably expanding the light output field could be achieved without introducing undue complexity into the structure of the unit.

SUMMARY OF THE INVENTION

A strobe unit includes a wall mountable housing. Electronic drive circuitry is carried by the housing.

An elongated light source which has a central axis and first and second displaced ends along that axis is also carried by the housing. The first end of the light source engages the housing and the light source is oriented with its axis extending horizontally when the housing is wall mounted. When so mounted, the light source extends perpendicular to the wall.

A reflector is carried by the housing. The reflector partially surrounds the elongated light source with the axis of the light source extending in a plane of symmetry of the reflector.

The reflector includes first and second mirror image elements wherein the elements abut each other and are positioned on opposite sides of the plane of symmetry. At least some of the elements include a plurality of convex, elongated, partial parabolic segments.

When the light source is energized by the electronic drive circuitry, it emits pulses of light which can be viewed directly by an individual in the vicinity of the housing. Additionally, the source emits light which is reflected by the reflector before being viewable by the individual.

The source emits light directly and without blockage along an arc on the order of one hundred and eighty degrees. The arc is symmetrically located relative to the axis of the elongated source and is oriented so as to be perpendicular to the plane of symmetry of the reflector.

In one aspect, first and second partial parabolic surfaces are carried by the reflector wherein the surfaces are oriented so as to extend parallel to the axis of the source. The surfaces have a height which is comparable to the length of the elongated source. The source is located at a focal point of the partial parabolic reflector elements.

In yet another aspect, light output is improved by providing first and second regions at distal ends of the first and second partial parabolic reflectors. The first and second regions are located at a predetermined angle with respect to the respective reflector element. The regions are planar and extend parallel to the axis of the light source and at a constant distance with respect thereto.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 12 is a perspective view of a preferred embodiment of the reflector and associated light source;

FIG. 13 is a top plan view of the reflector and light source of FIG. 12;

FIG. 14 is a front elevational view of the reflector and light source of FIG. 12;

FIG. 15 is a side elevational view of the reflector and light source of FIG. 12;

DETAILED DESCRIPTION OF THE PREFERRED EMBODIMENT

Figure 1:
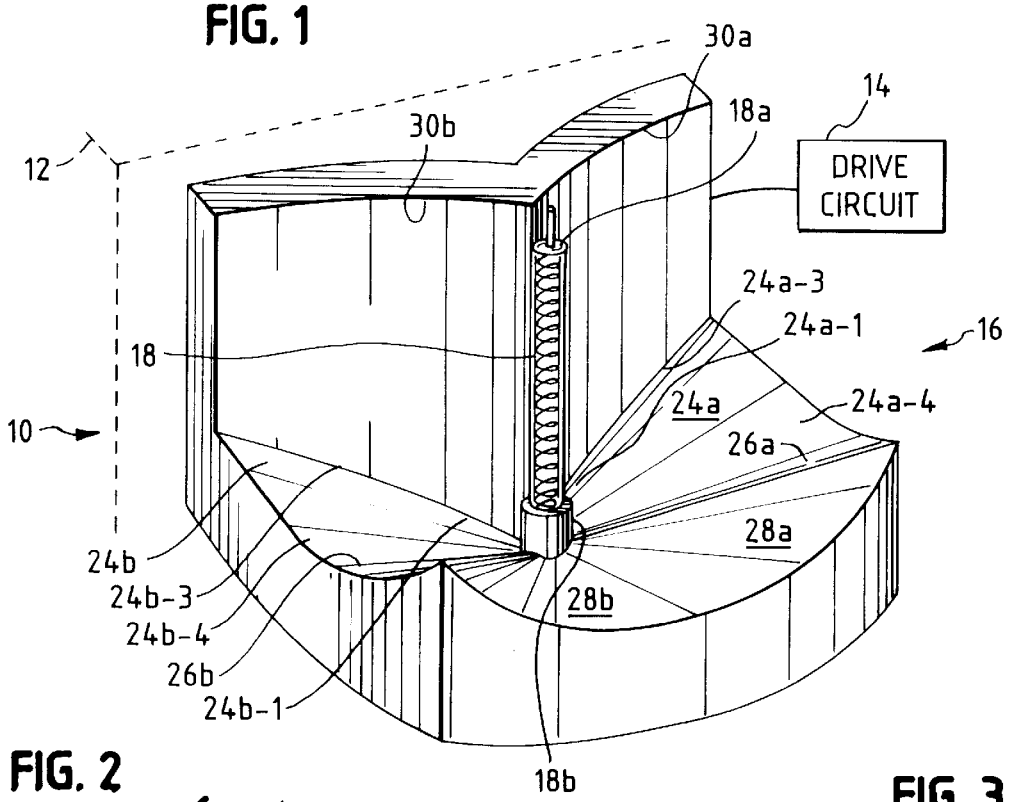
FIG. 1 is a perspective view of a strobe unit in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a view in perspective of a strobe unit 10 in accordance with the present invention. The unit 10 includes a housing 12, illustrated in phantom, and drive circuitry 14 carried by the housing 12.

The housing 12 also includes a multi-element reflector indicated generally at 16 and an elongated light source, which could be a gas filled glass tube, 18.

The light source 18 has first and second ends generally indicated at 18*a* and 18*b*. The source 18 is carried at end 18*b* on either the reflector 16 or the housing 12.

The housing 12 is intended to be wall mounted, on a vertical wall, in a normal installation. When so mounted, the source 18 extends generally horizontally and is perpendicular to the wall upon which the housing 12 is mounted. The wall thus forms a vertical plane and the light source 18 extends in a horizontal plane.

The reflector 16 can be molded plastic with a deposited or a painted reflective exterior surface applied thereto. It will be understood that the exact composition of the material which makes up the reflector 16 is not a limitation of the present invention.

Figure 2:
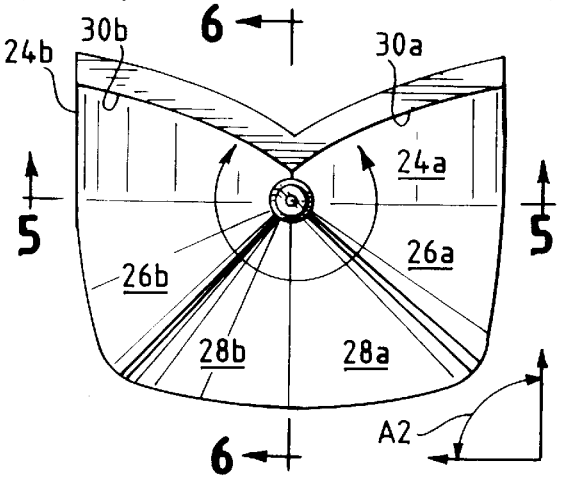
FIG. 2 is a top plan view of the reflector and light source of the strobe unit of FIG. 1.

The reflector 16 is formed of a plurality of elements which are symmetrically located with respect to a plane of symmetry. This plane of symmetry is best illustrated in FIG. 2 and is identified by identification numerals 6—6. Thus, the plane which identifies the section of FIG. 6 also is the plane of symmetry of the reflector 16.

The reflector 16 includes the following elements:

Elements 24*a*, 24*b* are planar elements having first and second ends wherein the first ends 24*a*-1 and 24*b*-1 are located adjacent to and on opposite sides of the source 18. The planar elements 24*a* and 24*b* are bounded by first and second regions 24*a*-3, 24*a*-4 and 24*b*-3, 24*b*-4. The planar regions 24*a*, 24*b* extend preferably at an angle on the order or seventy-five degrees from an axis A of the light source 18 (best seen in FIG. 5).

Positioned adjacent to the planar surfaces 24*a*, 24*b* are first and second partly curved surfaces 26*a*, 26*b*. The surfaces 26*a*, 26*b* extend coextensive with the planar surfaces 24*a*, 24*b* and are located on opposite side of the elongated light source 18. The elements 26*a*, 26*b* are mirror images of one another. Each of the surfaces 26*a*, 26*b* is formed of seven elongated, partial, parabolic, aiming sections which are used to direct light emitted by the source 18 after a reflection, in a variety of directions, as discussed subsequently.

The reflector 16 also includes first and second symmetrical, generally curved reflector sections 28*a* and 28*b*. The sections 28*a*, 28*b* are coextensive with previously discussed sections 26*a*, 26*b* and coextensive with each other.

Each of the sections 28*a*, 28*b* abuts the source 18. They are symmetrically disposed with respect thereto. The sections 28*a*, 28*b* are mirror images of each other. The sections 26*a*, 26*b* are mirror images of each other.

The reflector 16 also includes sections 30*a* and 30*b*, each of which is formed as a partial parabolic reflector element wherein the source 18 is located at a focal point thereof. The elements 30*a*, 30*b*, are extended linearly along the axis A of the source 18 and are essentially parallel thereto. The elements 30*a*, 30*b* emit light from the source 18 at angles at 0 to 90° in the horizontal plane, as discussed subsequently.

The reflector surfaces 30*a*, 30*b* extend coextensive with the planar surfaces 24*a*, 24*b* along intersection regions 24*a*-3 and 24*b*-3.

Figure 3:
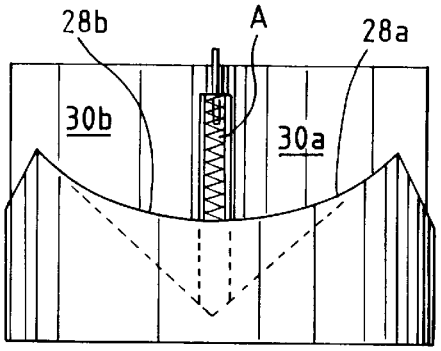
FIG. 3 is a front elevational view of the reflector and light source of the strobe unit of FIG. 1.
Figure 4:
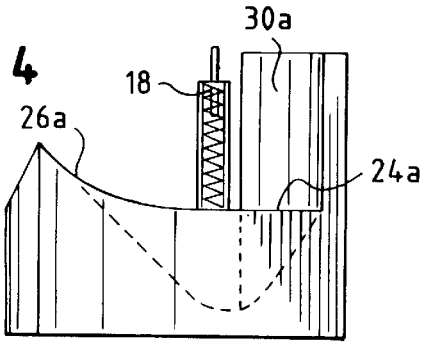
FIG. 4 is a side elevational view of the reflector and light source of the strobe unit of FIG. 1.

FIG. 2 is a top view of the reflector 16 and light source 18. FIG. 2 illustrates an arc A1 which extends through an angle of more than one hundred and eighty degrees around the source 18. The arc A1 indicates a viewing angle around the source 18 wherein radiant energy emitted from the source may be directly viewed by an individual without requiring intervening reflections. FIG. 3 and FIG. 4 are front and side elevational views respectively.

Figure 5:
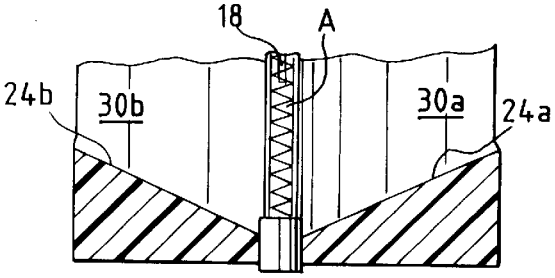
FIG. 5 is a sectional view taken along plane 5—5 of FIG. 2.
Figure 6:
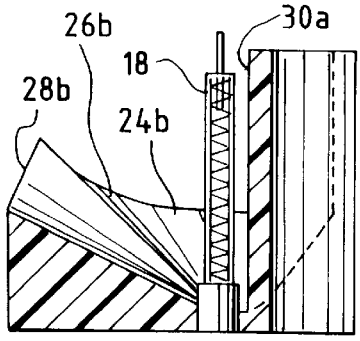
FIG. 6 is a sectional view taken along plane 6—6 of FIG. 2.

FIG. 5 is a sectional view taken along plane 5—5 illustrating planar elements 24*a*, 24*b*, oriented at an angle on the order of twenty-five degrees relative to a perpendicular to the axis A of the source 18. FIG. 6 a sectional view taken along plane 6—6, the plane of symmetry of the reflector 16, illustrates various of the reflective elements. FIG. 6 also illustrates arc A2 which extends through an angle of ninety degrees and is indicative of a viewing angle of light from the source 18 in a vertical plane without intervening reflections.

Figure 7:
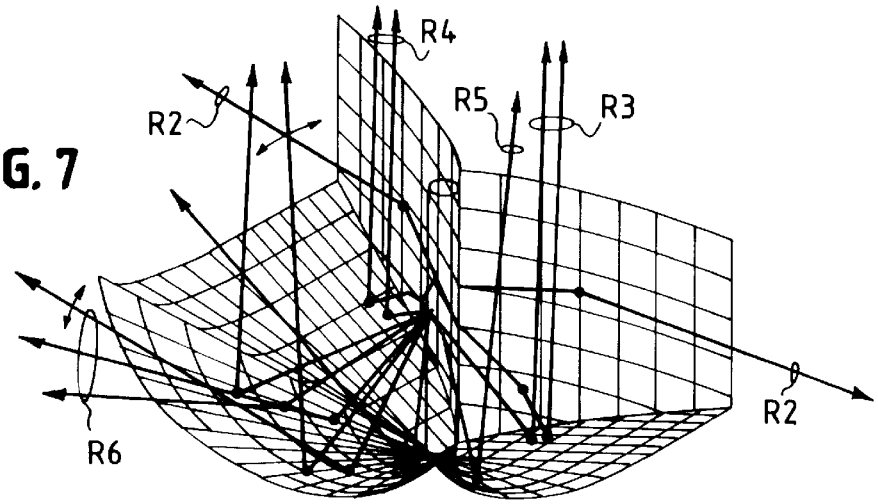
FIG. 7 is a wire-frame perspective view of the strobe unit of FIG. 1 illustrating various output rays of light.

FIGS. 7 through 10 illustrates perspective, front and side views respectively wherein the reflector 16 is illustrated in wire-frame form, for the purpose of indicating emission of light from the source 18 in various directions. As illustrated in FIG. 7, rays R1, R2 are directed, after one reflection, off of elements 30*a*, 30*b* respectively outwardly from the source 18 in a horizontal plane perpendicular to the axis of the source 18.

Rays R3, R4, some of which require two reflections, are directed horizontally off of the planar regions 24*a*, 24*b* in a horizontal plane toward the front of the unit, at angles of 0 to 50°. Ray R5 is directed primarily in a horizontal plane off of various portions of the parabolic sections 26*a*, 26*b* in a 10 to 60 degree range of the horizontal field. Rays R6 are reflected off of parabolic sections of elements 28*a*, 28*b* primarily in a vertical field at various angles.

Figure 8:
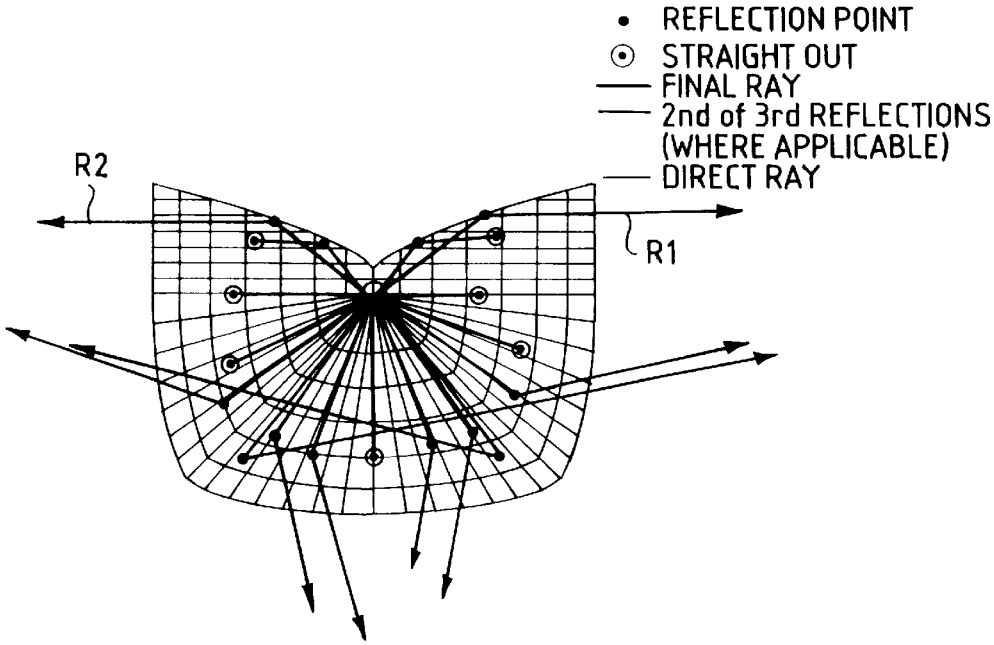
FIG. 8 is a top plan wire-frame view of the unit of FIG. 1 illustrating rays of light output from the source.
Figure 9:
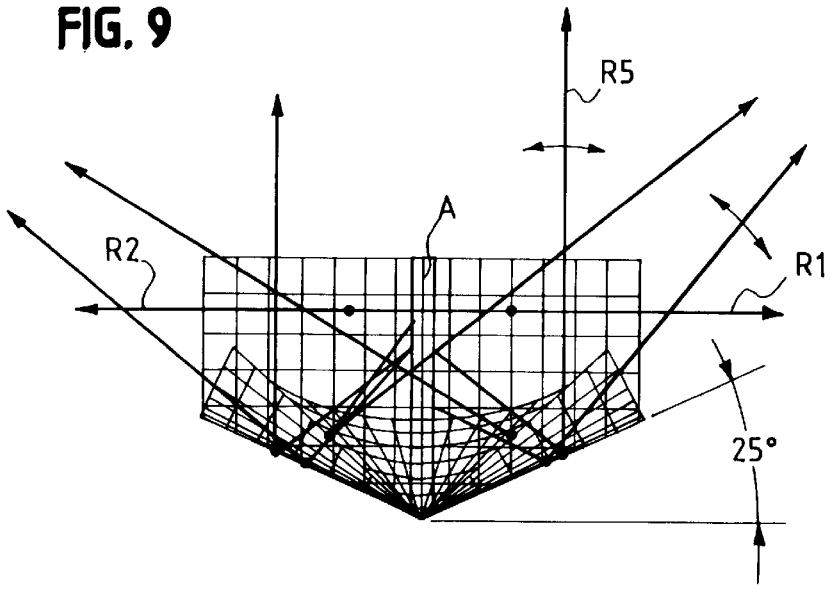
FIG. 9 is a front elevation wire-frame view of the unit of FIG. 1 illustrating rays of light output from the source.
Figure 10:
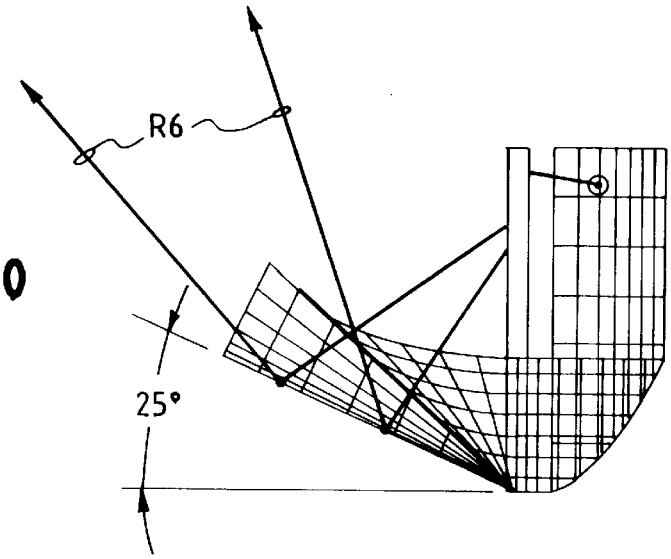
FIG. 10 is a side elevational wire-frame view of the unit of FIG. 1 illustrating rays of light output from the source.

FIGS. 8, 9 and 10 illustrate additional rays, some of which are reflected off of one or more elements of the reflector 16.

Figure 11:
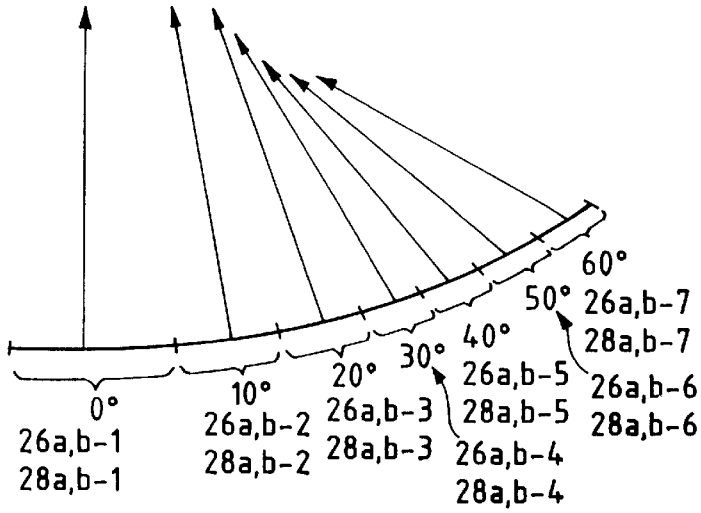
FIG. 11 is an enlarged partial view of the unit of FIG. 1 illustrating segments of some of the reflector elements of FIG. 1.
Figure 16:
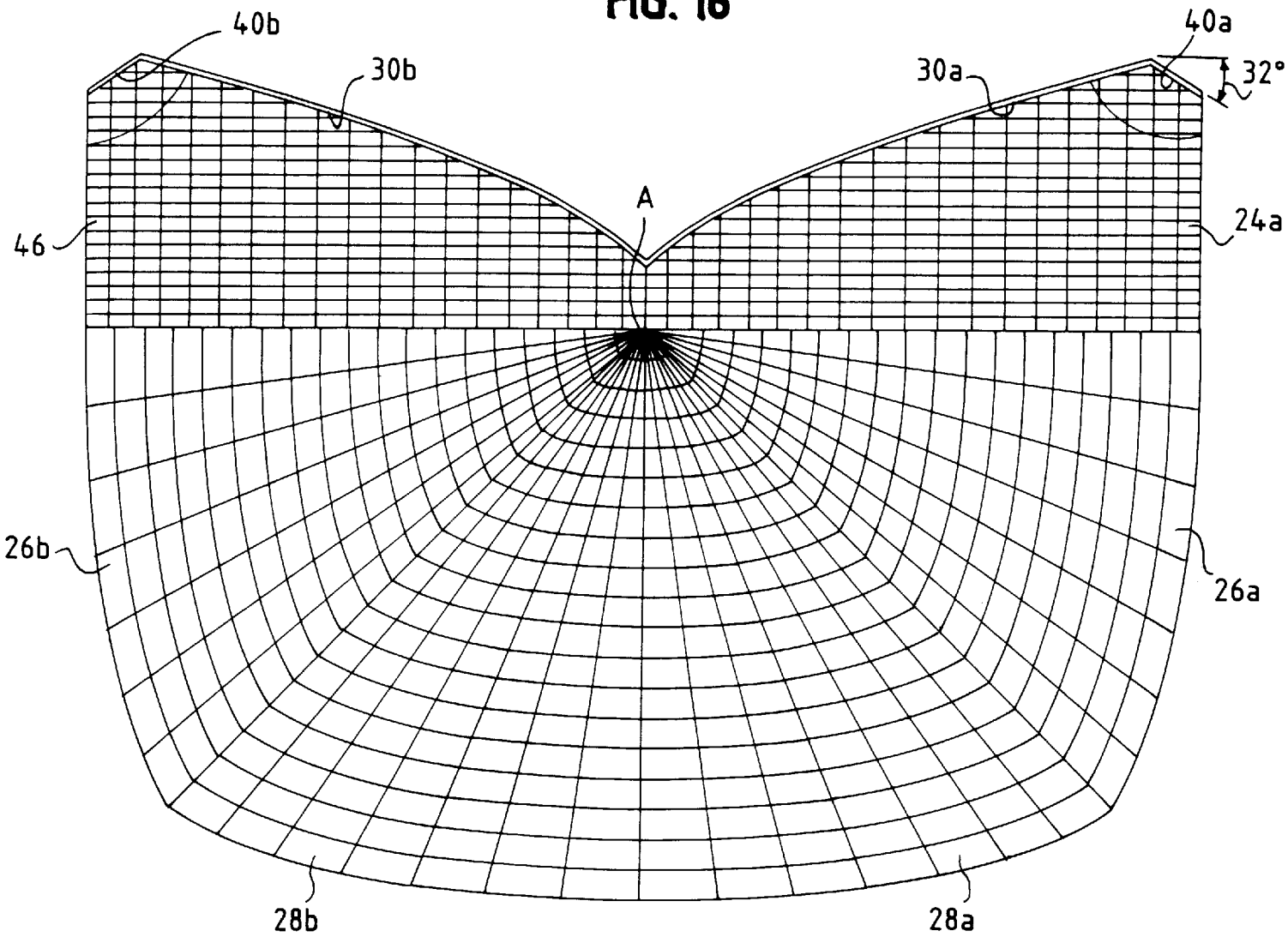
FIG. 16 is a top plan wire frame view of the reflector of FIG. 12.
Figure 17:
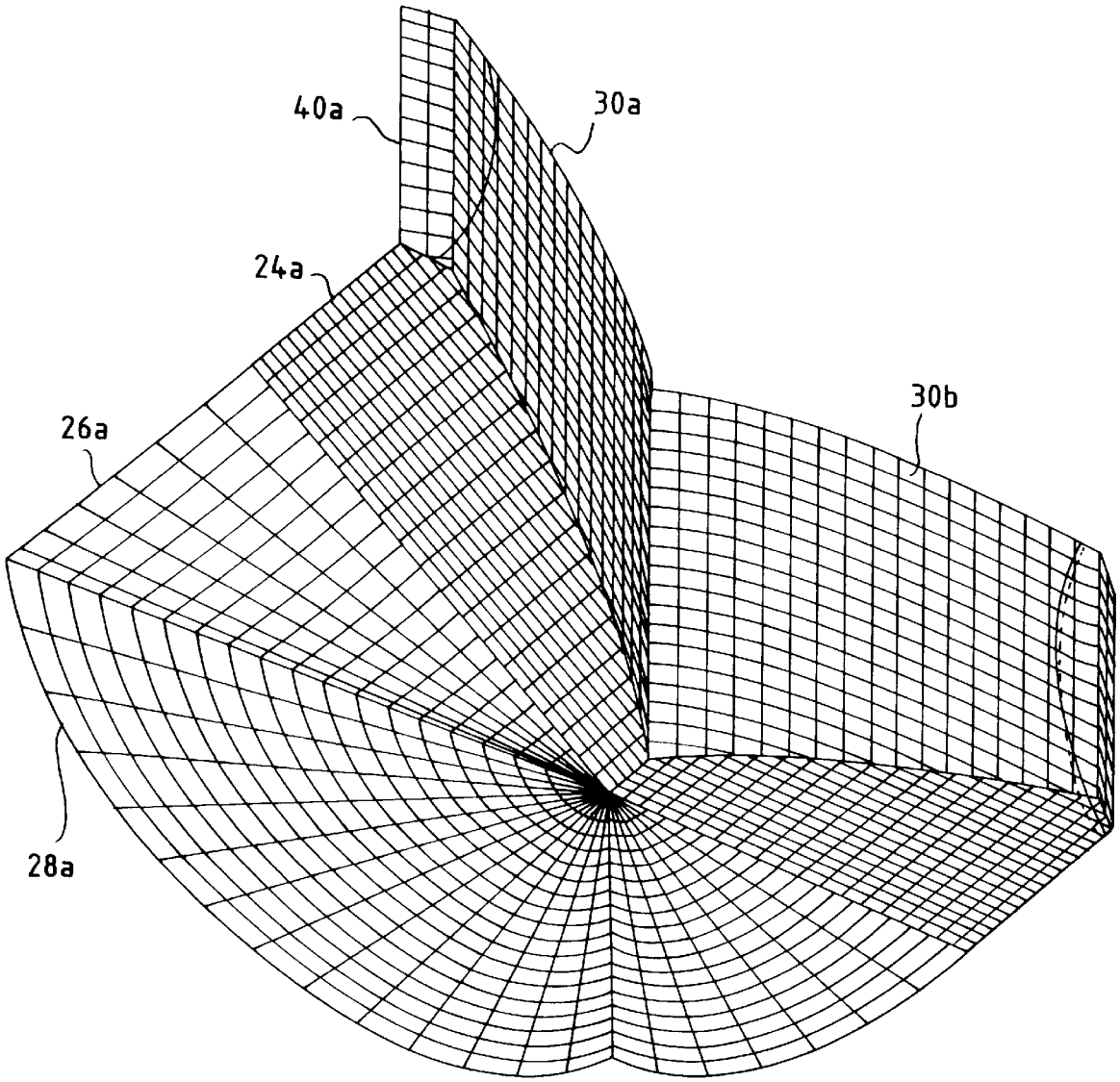
FIG. 17 is a perspective wire frame view of the reflector of FIG. 12.
Figure 18:
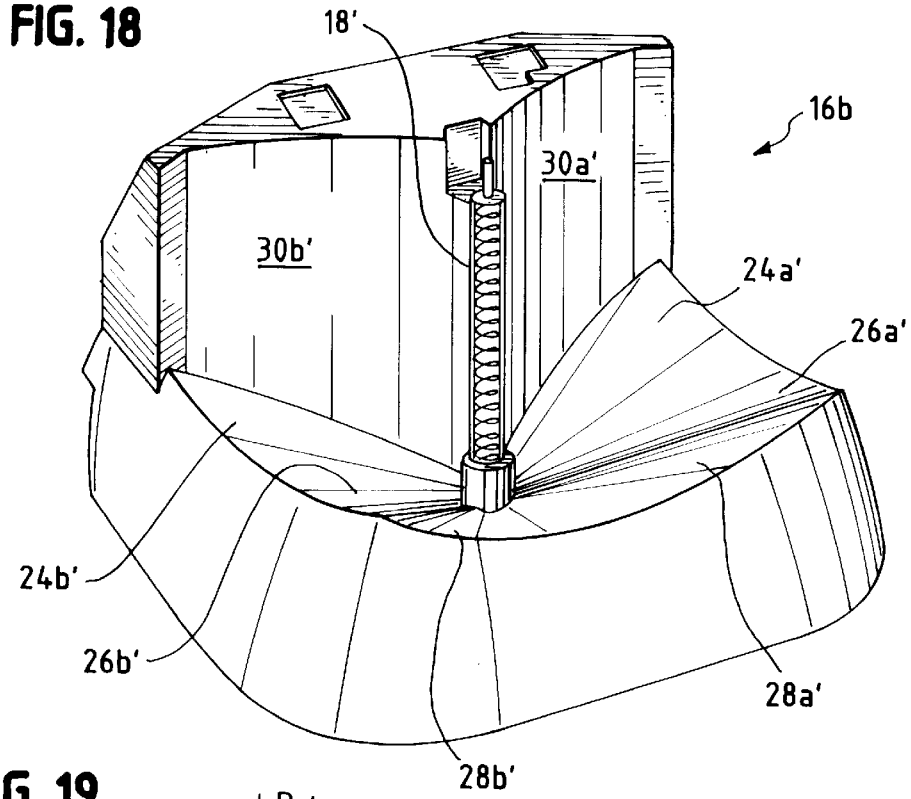
FIG. 18 is a perspective view of another reflector.

FIG. 11 illustrates in greater detail the structure and relationship of the multiple elongated partial parabolic segments which make up reflector elements 26*a*, 26*b* and 28*a*, 28*b*. Each element includes 7 parabolic sections such as 26*a*-1 to 26*a*-7, which direct light at selected angles relative to the horizontal or the vertical measuring, plane.

The elongated partial parabolic sections 30*a*, 30*b* contribute to light output in both horizontal and vertical profiles. In a horizontal profile, the light is directly from the source 18 at angles of 5 to 90 degrees in the horizontal plane. Additionally, sections 30*a*, 30*b* reflect light from the source 18 to sections 24*a*, 24*b* at angles of zero to about 50 degrees in the horizontal plane.

In the vertical plane, sections 30*a*, 30*b* reflect light from the source 18 at angles on the order of 10 to 50 degrees in the vertical plane. Sections 30*a*, 30*b* also reflect light to sections 24*a*, 24*b* which are emitted at angles of zero to 40 degrees in the vertical plane.

Planar sections 24*a*, 24*b* contribute to light output in both the horizontal plane and the vertical plane. Sections 24*a*, 24*b* reflect light from the source 18 at angles on the order of zero to 65 degrees in the horizontal plane. Additionally, sections 24*a*, 24*b* reflect light to sections 30*a*, 30*b* for output from sections 30*a*, 30*b* in the horizontal plane at angles 5 to 45 degrees.

Planar sections 24*a*, 24*b* contribute light from the source 18 to the vertical plane by reflecting light from the source at angles of zero to ten degrees in the vertical plane. Additionally, planar sections 24*a*, 24*b* reflect light to sections 30*a*, 30*b* respectively for output in the vertical plane at angles of zero to 15 degrees.

Sections 26*a*, 26*b* contribute output light primarily to the horizontal plane. Light from the source 18 is reflected directly therefrom at angles of zero to 65 degrees in the horizontal plane. Sections 26*a,b*-1 through 26*a,b*-3 reflect light from the source 18 in the horizontal plane at angles on the order of zero to 40 degrees. Sections 26*a,b*-4 through 26*a,b*-7 reflect light from the source 18 at angles on the order of 40 to 60 degrees in the horizontal plane. Sections 26*a,b*-1, reflect light from the source 18 at angles on the order of zero to 65 degrees in the horizontal plane.

Reflector sections 28*a*, 28*b* function identically to reflector sections 26*a*, 26*b* except that the light is output in the vertical plane. Additionally, sections 28*a,b*-1 through 28*a, b*-7 contribute reflected light from the source 18 at angles on the order of zero to 65 degrees in the horizontal plane.

FIGS. 12 through 17 illustrate a preferred reflector embodiment 16*a*. Elements in FIGS. 12 through 17 which are the same as in FIGS. 1 through 6 have been numbered accordingly.

The reflector 16*a* includes first and second elongated elements 40*a*, 40*b* which are located at the ends of the partial parabolic elements 30*a*, 30*b*. The elements 40*a*, 40*b* are planar and are oriented at an angle on the order of 32 degrees with respect to a plane which is perpendicular to the plane of symmetry, plane 6—6 indicated in FIG. 13. The planar elements 40*a*, 40*b* increase light output in the vertical plane.

In summary, reflectors of the type illustrated in FIGS. 1 through 17 include an elongated source of illumination which is intended to be oriented with an axis "A" which extends horizontally when the unit is mounted with a normal orientation. The reflector is symmetrical about a plane extending vertically through the horizontally extending axis of the source of illumination.

Extending from each side of the source of illumination, and parallel thereto, are first and second reflective surfaces which are identified as 30*a,b* in FIG. 1. The surfaces 30*a*, 30*b* have a partly parabolic shape. The source is located at the focus of the respective parabola.

The surfaces 30*a*, 30*b*, abut respectively reflective members 24*a* and 24*b* . The members 24*a*, 24*b* in turn abut and blend into a plurality of partial parabolic elements which form the surfaces 26(*a*) and 26(*b*). The elements 24*a* and 26*a* are mirror images of the elements 24*b*, 26*b*.

The regions 24*a,b* are substantially planar and extend from the surfaces 30*a*, 30*b* to a plane defined by the axis of the source, plane $P_H$. The elements 24*a*, 24*b* extend at an angle on the order of 65 degrees relative to the axis A of the source.

Surfaces 26*a,b* which are formed of a plurality of curved partial parabolic elements curve toward the surfaces 28*a*, 28*b*. The elements 26*a*, 28*a* and 26*b*, 28*b* are mirror images.

The reflector of FIGS. 12–17 can be used with a common bulb 18 with three different drive circuits to produce 15, 75 and 100 candelas of light distributed in accordance with U.L. Standard 1971. In addition, the open structure of the disclosed reflectors produces a visible distribution of light off of the horizontal and vertical planes as required by U.L. 1971.

FIGS. 18 through 26 illustrate an alternate reflector 16*b*. The reflector of FIGS. 18 through 26 is intended to output 75 candelas of light when viewed head on and to conform to UL Standard 1971 for the horizontal and vertical distributions of light for a 15 candela source.

As illustrated, planar regions 24*a*' and 24*b*' extend from an axis A' toward the outer edges of the reflector as is the case with regions 24*a,b*. The regions 24*a',b*' extend at an angle on the order of 60° to the axis A' of the source of illumination.

Regions 26*a*', 26*b*', 28*a*' and 28*b*' are identical partial parabolic reflectors. Sections 26*a*', 28*a*' are mirror images of sections 26*b*', 28*b*'. Section 24*a*' is a mirror image of section 24*b*'. FIGS. 23–26 are wire frame views of the reflector 16*b* illustrating exemplary reflections of light rays emanating from the source 18'.

Figure 19:
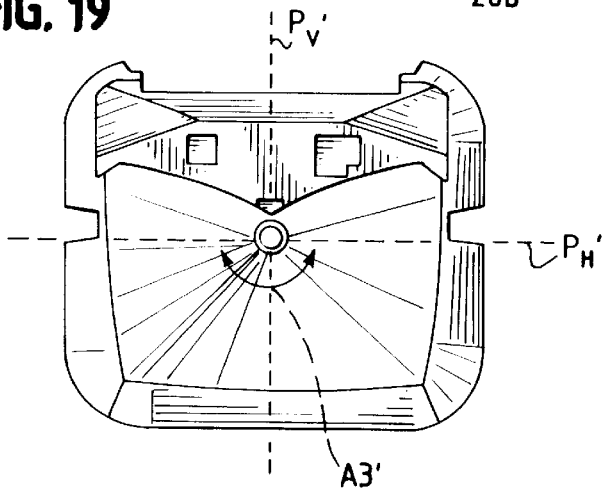
FIG. 19 is a top plan view of the reflector of FIG. 18.
Figure 20:
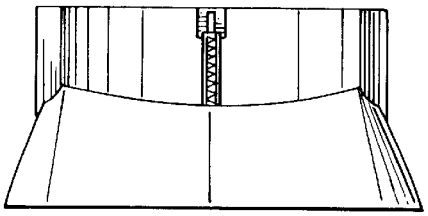
FIG. 20 is a top plan view of the reflector of FIG. 18.
Figure 21:
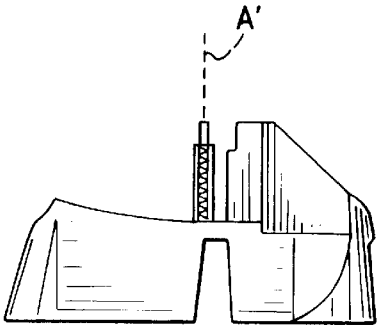
FIG. 21 is a side elevational view of the reflector of FIG. 18.
Figure 22:
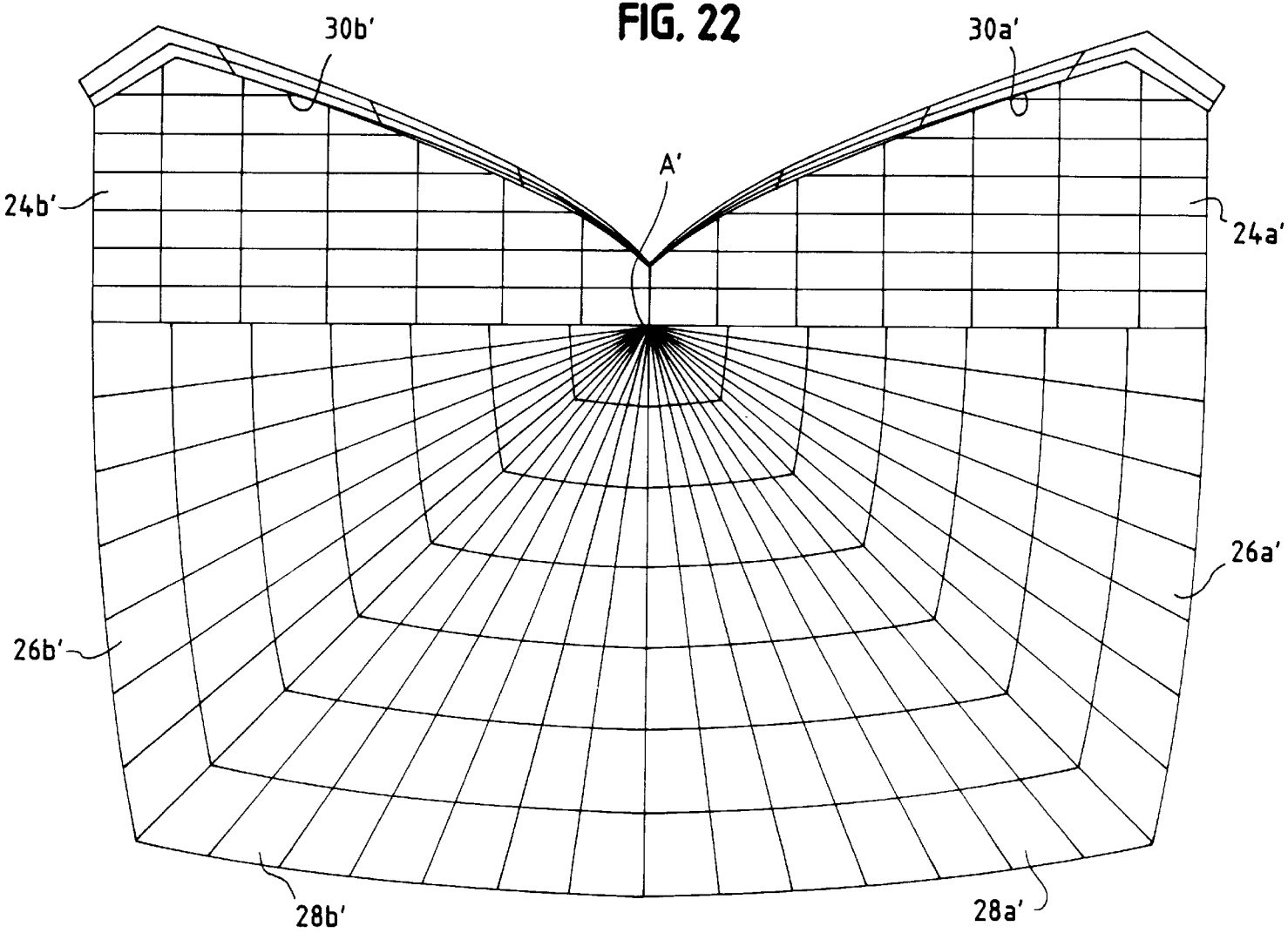
FIG. 22 is a top plan, wire frame view of the reflector of FIG. 18 illustrating elements of the reflector of FIG. 18.
Figure 23:
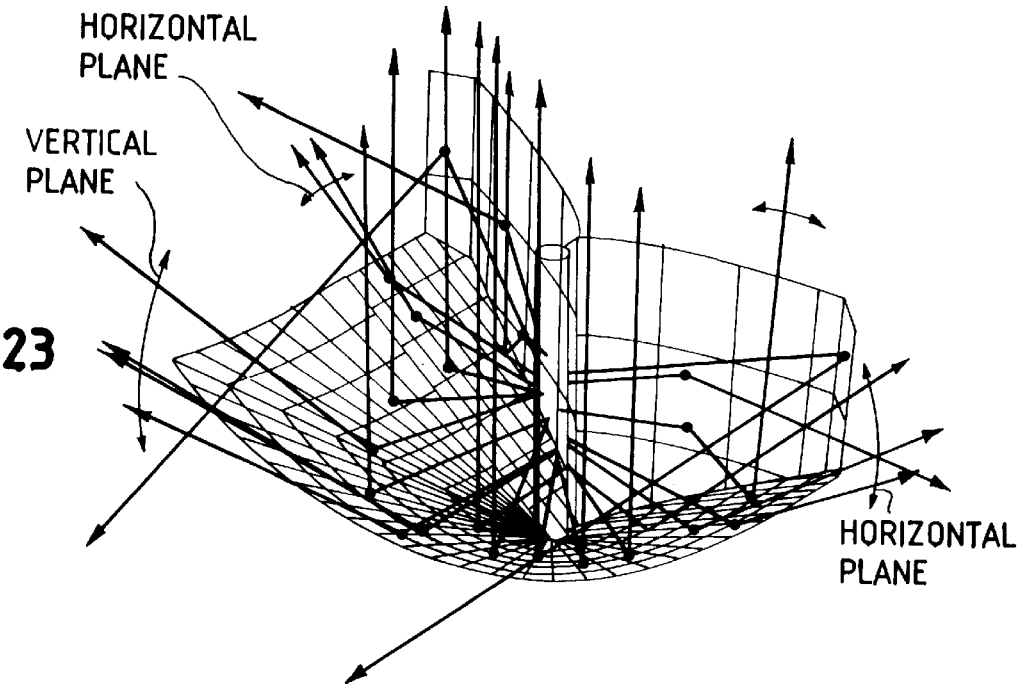
FIG. 23 is a wire-frame perspective view of the reflector of FIG. 18 illustrating rays of light output from the source.
Figure 24:
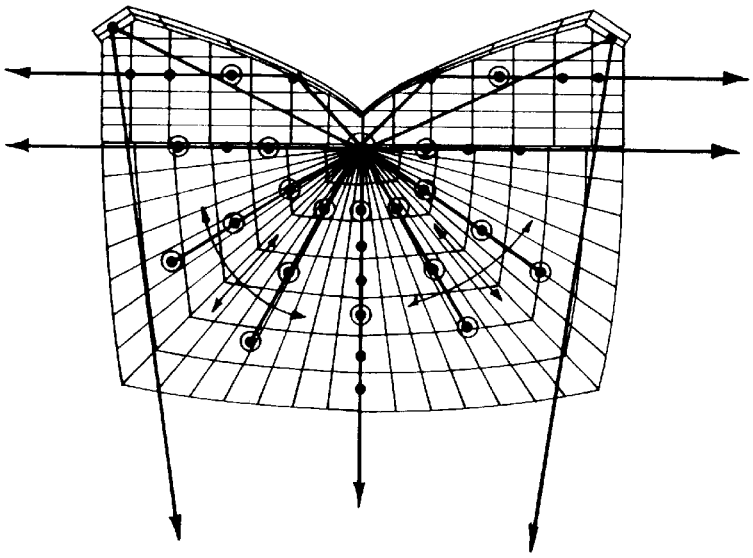
FIG. 24 is a top plan wire-frame view of the reflector of FIG. 18 illustrating rays of light output from the source.
Figure 25:
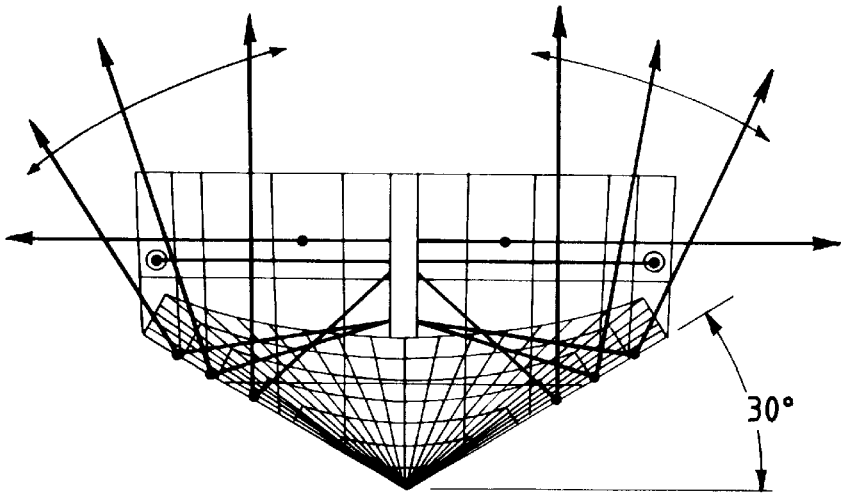
FIG. 25 is a front elevation wire-frame view of the reflector of FIG. 18 illustrating rays of light output from the source.
Figure 26:
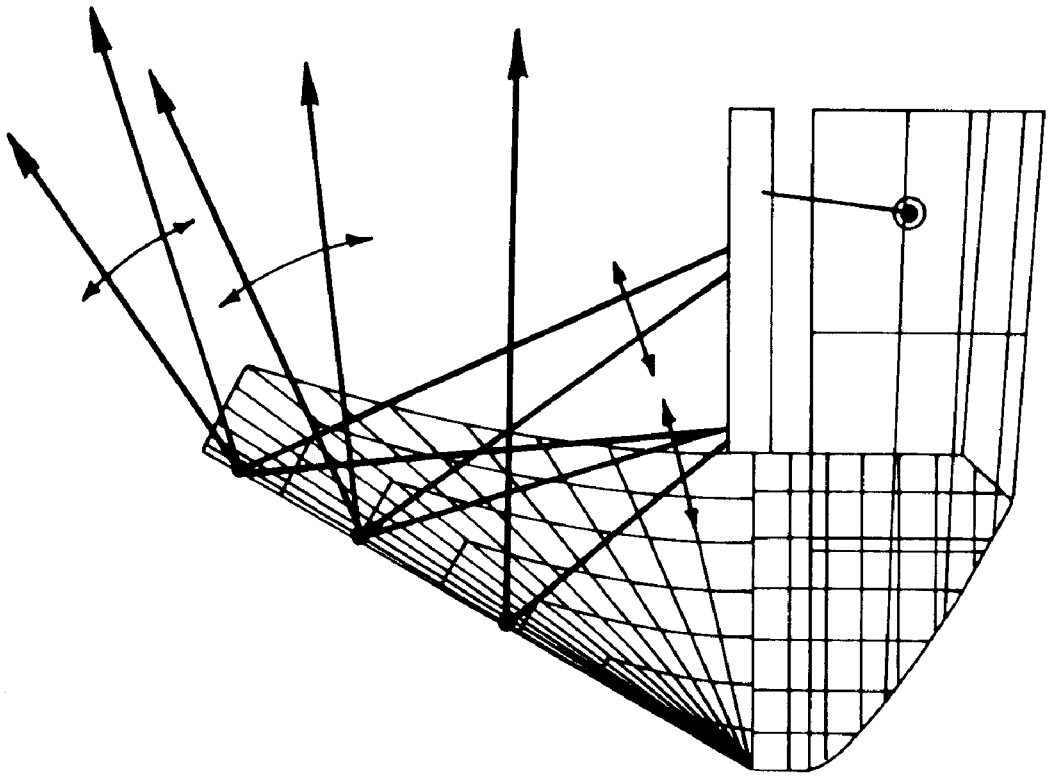
FIG. 26 is a side elevational wire-frame view of the reflector of FIG. 18 illustrating rays of light output from the source.

None of the reflectors described above incorporate elements which are trough-like and have opposing side surfaces. Hence, a continuous distribution of light will be produced from the elongated source about an angle A3, A3' in a plane perpendicular to the axis of the source (which plane will be vertical when the axis of the source is oriented so as to be horizontal). This angle extends 180°, below the light source when the axis thereof extends horizontally. This continuously, emitted light pattern is achieved by not blocking out portions of the source with the reflector anywhere along the 180° extent of the angle A3 as illustrated in FIG. 13 and A3' as illustrated in FIG. 19.

The non-trough like structure and exposed elongated source of the illustrated reflectors can also be expected to produce a light distribution at locations off of the horizontal and vertical planes $P_H$ and $P_V$, $P'_H$ and $P'_V$.

From the foregoing, it will be observed that numerous variations and modifications may be effected without departing from the spirit and scope of the invention. It is to be understood that no limitation with respect to the specific apparatus illustrated herein in tended or should be inferred. It is, of course, intended to cover by the appended claims all such modifications as fall within the scope of the claims.

I claim:

1. A reflector for use with an elongated source of illumination having a predetermined length and an axis of symmetry, the reflector comprising:

first and second reflector elements wherein the elements are mirror images of one another about a plane that extends through the axis and wherein each of the elements includes at least first and second partial parabolic surfaces, wherein the surfaces extend from the source at an angle in excess of fifty degrees, relative to the axis of the source, and first and second elongated partial parabolic reflector elements which are mirror images across said plane with the source at a focal point thereof, with the axis of symmetry being parallel to a direction of elongation of the first and second elongated reflector elements.

2. A reflector as in claim 1 which includes a planar element which extends from the source between the first reflector element and the elongated element at an angle in excess of fifty degrees relative to the axis of the source, and wherein the source is directly visible by an observers eye located at a distance from said reflector, the observers eye locatable at a range of positions defining direct lines between the observer's eye and the source, the direct lines sweeping an uninterrupted angle on the order of one hundred eighty degrees in a plane perpendicular to the axis of the source.

3. A reflector as in claim 1 wherein the first and second elements are curved and continuously abut one another.

4. A reflector as in claim 3 which includes a planar element.

5. A reflector as in claim 4 wherein the planar element is interposed between the elongated reflector element and one of the first and second elements.

6. A reflector as in claim 5 wherein the planar element is oriented substantially at ninety degrees to the elongated element.

7. A reflector as in claim 1 which includes drive circuitry for energizing the source.

8. A reflector as in claim 6 wherein the first and second reflector elements are oriented at an angle in excess of fifty degrees from the elongated element.

9. A reflector as in claim 7 wherein the source has a contact at a proximal end, adjacent the reflector elements and a contact at a distal end, displaced from at least the first and second surfaces of the reflector elements and wherein the contact at the distal end is coupled to the drive circuitry by a conductor which extends along the source.

10. A visual alarm indicating unit comprising:

a support;

a drive circuit carried by the support;

at least one terminal carried by the support, coupled to the drive circuit, for providing electrical energy to the drive circuit;

an elongated source, carried by the support and coupled to the drive circuit, wherein the source has an axis of symmetry which extends substantially perpendicular to the support;

a reflector, carried by the support and substantially surrounding a proximal end of the source adjacent to the support, wherein the source is directly visible along a line to an external observer said line located arbitrarily along a one hundred eighty degree angle located in a plane perpendicular to the source.

11. A unit as in claim 10 wherein the reflector includes:

first and second reflector elements wherein the elements are mirror images of one another about a plane that extends through the axis and wherein each of the elements includes at least first and second partial parabolic surfaces with the source located at a focal point thereof wherein the surfaces extend from the source at an angle in excess of forty five degrees, relative to the axis of the source, and only a single elongated partial parabolic reflector element with the source at a focal point thereof and wherein the elongated element, has first and second spaced apart edges that extend equidistant from the axis of the source.

12. A unit as in claim 11 which includes a planar element which extends between one of the parabolic surfaces and the elongated element.

13. A unit as in claim 11 wherein the first and second surfaces continuously abut one another.

14. A reflector for use with an elongated light source, having first and second displaced ends with an axis extending therebetween, the reflector comprising:

first and second substantially planar, elongated reflecting surfaces wherein said surfaces each have a proximal end and a distal end with first and second elongated edges therebetween and wherein said proximal ends are located adjacent to one another with the first end of the light source positioned therebetween with the second end of the light source symmetrically located distally of said adjacently located proximal ends and wherein said surfaces extend at an acute angle relative to a perpendicular plane to the elongated source;

third and fourth partly, curved, elongated, reflecting surfaces wherein said partly curved surfaces each have a proximal end and a distal end with third and fourth elongated edges therebetween wherein said proximal ends of said third and fourth reflecting surfaces are located adjacent to one another with the first end of the light source positioned therebetween wherein each of said third edges abuts a respective one of said first edges and is coextensive therewith; and fifth and sixth, partly curved, elongated reflecting surfaces wherein each of said fifth and sixth surfaces has a proximal end and a distal end with fifth and sixth elongated edges therebetween wherein said proximal ends of said fifth and sixth reflecting surfaces are located adjacent to the first end of the light source, wherein each said fifth edge abuts a respective one of said fourth edges and is coextensive therewith and wherein said sixth edges abut one another, are coextensive and extend at an acute angle relative to a perpendicular to the axis of the light source.

15. A reflector as in claim 14 which includes:

seventh and eighth reflective elements wherein said seventh and eighth elements abut said second edges of respective first and second elements and extend parallel to the elongated light source.

16. A reflector as in claim 14 wherein said curved surfaces are each formed of a plurality of elongated, partial parabolic segments.

17. A reflector as in claim 15 wherein said seventh and eight elements are shaped as partial parabolic reflectors and wherein the light source is located at a common focal point thereof.

18. A reflector as in claim 17 wherein said seventh and eighth elements extend along the light source a predetermined distance and wherein said distal ends of said fifth and sixth reflecting surfaces extend along the light source a lesser distance than said predetermined distance.

19. A reflector as in claim 14 wherein the light source emits light directly on an arc which extends through an angle of at least one hundred eighty degrees wherein said arc is symmetrically located in a plane which is perpendicular to the axis.

20. A reflector as in claim 19 wherein the light source emits light directly, without reflection on a second arc which extends through an angle of at least ninety degrees wherein said second arc is located in a plane of symmetry of the reflector.

21. A reflector as in claim 17 wherein said seventh and eights reflective surfaces each have a proximal end located adjacent to the source and each have a distal end displaced from the source wherein said distal ends of said seventh and eighth surfaces each carry a planar output altering element.

22. A reflector as in claim 21 wherein said planar output altering elements extends parallel to the source.

23. A strobe unit comprising:

a housing;

electronic drive circuitry carried by said housing;

an elongated light source having a central axis with said light source carried by said housing and with said axis extending perpendicular to said housing;

a reflector carried by said housing wherein said reflector is symmetrical with respect to a plane of symmetry, wherein said axis of said source extends in the plane of symmetry of said reflector, said reflector having first and second mirror image elements wherein said elements abut each other and are positioned on opposite sides of said plane wherein at least some of said elements include a plurality of convex, elongated, partial parabolic segments and wherein said light source emits light directly from said strobe unit on an arc which exceeds one hundred eighty degrees symmetrically located relative to said central axis and is perpendicular to said plane of symmetry.

24. A reflector for use with an elongated source of illumination having a predetermined length and an axis of symmetry, the reflector comprising:

first and second reflector elements wherein the elements are mirror images of one another about a plane that extends through the axis, and wherein each of the elements includes at least first and second partial parabolic surfaces and, third and fourth reflector surfaces wherein the third and fourth surfaces are mirror images of one another about the plane wherein the third surface is adjacent to, and on the same side of the plane, as the first element, and the fourth surface is adjacent to, and on the same side of the plane, as the second element, wherein the third and fourth surfaces are oriented at an angle relative to respective first and second surfaces and wherein each of the third and fourth surfaces carries an elongated end surface, each of which is elongated in a direction parallel to the axis.

25. A reflector for use with an elongated source of illumination having a predetermined length and an axis of symmetry, the reflector comprising:

first and second reflector elements wherein the elements are mirror images of one another about a plane that extends through the axis, first and second elongated partial parabolic reflector elements which are mirror images across said plane with the source at a focal point thereof, with the axis of symmetry parallel to a direction of elongation of the first and second elongated reflector elements;

wherein said first and second reflector elements each comprise multiple partial parabolic reflective surface segments arranged sequentially edge-to-edge with each adjacent segment having a curvature to focus reflected light at a different angle.

26. A reflector for use with an elongated source of illumination having a predetermined length and an axis of symmetry, the reflector comprising:

first and second reflector elements wherein the elements are mirror images of one another about a first plane that extends through the axis and wherein each of the elements includes at least first and second partial parabolic surfaces, first and second elongated partial parabolic reflector elements which are mirror images across said first plane with the source at a focal point thereof, with the axis of symmetry parallel to a direction of elongation of the first and second elongated reflector elements; and elongated planar facets along distal edges of said first and second elongated partial reflector elements, wherein said elongated planar facets are elongated in a direction parallel to said axis and arranged in mirror image fashion across said first plane and oriented at an acute angle relative to a second plane which is perpendicular to said first plane and parallel to said axis.

27. A reflector as in claim 26 which includes a first planar element which extends from the source between the first reflector element and the first elongated element at an angle in excess of fifty degrees relative to the axis of the source, and a second planar element formed in mirror image fashion to said first planar element across said first plane, and wherein the source is directly visible by an observer located at a moving position at a distance from said reflector said moving position sweeping an uninterrupted angle on the order of one hundred eighty degrees relative to in a plane perpendicular to the axis of the source.

28. A reflector as in claim 24 wherein the planar element is oriented substantially at ninety degrees to the elongated element.

29. A reflector as in claim 24 wherein the first and second reflector elements are oriented at an angle in excess of fifty degrees from the elongated element.

30. A reflector as in claim 24 comprising drive circuitry for energizing the source and wherein the source has a contact at a proximal end, adjacent the reflector elements and a contact at a distal end, displaced from at least the first and second surfaces of the reflector elements and wherein the contact at the distal end is coupled to the drive circuitry by a conductor.

31. A reflector as in claim 1, wherein said source is located at a focal point of said first and second partial parabolic surfaces.

32. A reflector as in claim 25, wherein said source is located at a focal point of said first and second partial parabolic surfaces.

33. A reflector as in claim 27, wherein said source is located at a focal point of said first and second partial parabolic surfaces.

* * * * *